US005811368A

United States Patent [19]

Fukuchi et al.

[11] Patent Number: 5,811,368

[45] Date of Patent: Sep. 22, 1998

[54] THERMAL SENSITIVE RECORDING MEDIUM

[75] Inventors: Tadakazu Fukuchi; Kaoru Hamada; Tomoaki Nagai; Nobuhiro Kudoh; Akio Sekine, all of Tokyo, Japan

[73] Assignee: Nippon Paper Industries Co., Ltd., Tokyo, Japan

[21] Appl. No.: 759,705

[22] Filed: Dec. 6, 1996

[30] Foreign Application Priority Data

Dec. 8, 1995 [JP] Japan ..... 7-319922

[51] Int. Cl.[6] ..... B41M 5/155

[52] U.S. Cl. ..... 503/209; 503/216; 503/225

[58] Field of Search ..... 427/150, 151; 503/208, 209, 216, 225

[56] References Cited

U.S. PATENT DOCUMENTS

| | | | |
|---|---|---|---|
| 4,570,170 | 2/1986 | Hiraishi et al. | 503/209 |
| 5,665,675 | 9/1997 | Nagai et al. | 503/216 |

FOREIGN PATENT DOCUMENTS

| | | | |
|---|---|---|---|
| 0776769 | 6/1997 | European Pat. Off. | 503/209 |
| 2432938 | 3/1980 | France | 503/209 |
| 51-27599 | 8/1976 | Japan | 503/214 |
| 56-146794 | 11/1981 | Japan | 503/209 |
| 57-188394 | 11/1982 | Japan | 503/209 |
| 59-114096 | 6/1984 | Japan | 503/216 |
| 62-164579 | 7/1987 | Japan | 503/216 |
| 4-353490 | 12/1992 | Japan | 503/216 |
| 6-179289 | 6/1994 | Japan | 503/209 |
| 7-32744 | 2/1995 | Japan | 503/209 |
| 7-304727 | 11/1995 | Japan | 503/216 |
| 8-058242 | 3/1996 | Japan | 503/216 |
| 8-238851 | 9/1996 | Japan | 503/217 |
| 8-282117 | 10/1996 | Japan | 503/217 |
| 8-282120 | 10/1996 | Japan | 503/217 |
| 8-282121 | 10/1996 | Japan | 503/217 |
| 8-282122 | 10/1996 | Japan | 503/217 |
| 8-282123 | 10/1996 | Japan | 503/216 |
| 8-310134 | 11/1996 | Japan | 503/216 |
| 8-290672 | 12/1996 | Japan | 503/216 |
| 8-324127 | 12/1996 | Japan | 503/216 |

OTHER PUBLICATIONS

Patent Abstracts of Japan, vol. 96, No. 3, 29 Mar. 1996 & JP 07 304727 A Nippon Paper Industries Co. Ltd, 21 Nov. 1995.

Patent Abstracts of Japan, vol. 7, No. 37 (M–193), 15 Feb. 1983 & JP 57 188394 A (Ricoh K.K.), 19 Nov. 1982.

Patent Abstracts of Japan, vol. 18, No. 521 (M–1681), 30 Sep. 1994 & JP 06 179289 A (Nippon Kayaku Co. Ltd.), 28 Jun. 1994.

*Primary Examiner*—Bruce H. Hess

*Attorney, Agent, or Firm*—Sherman and Shalloway

[57] ABSTRACT

In a thermal sensitive recording medium comprising a thermal sensitive color developing layer which includes a basic leuco dye and an organic color developer on a substrate, characterized by the said thermal color developing layer includes 0.01–0.9 parts of aminobenzenesulfonamide derivatives indicated by general formula (I) based on 1 part of color developer and also includes at least one kind of methylolated fatty acid amide indicated by general formula (II) in proportion of 0.01–2 parts based on 1 part of color developer.

(I)

(wherein, "X" indicates an oxygen or sulfur atom, "R" indicates non-substituted or substituted phenyl group, naphthyl group, aralkyl group, lower alkyl group of carbon number 1–6, cycloalkyl group of carbon number 3–6 or lower alkenyl group of carbon number 2–6. "Z" indicates lower alkyl group of carbon number 1–6 or electron attractive group. "n" indicates an integer from 0 to 4 and "P" indicates an integer from 1 to 5, wherein satisfies the numerical formula of $n+p \leqq 5$)

$$R_1—CONHCH_2OH \quad (II)$$

(wherein, "$R_1$" indicates alkyl group of carbon number 11–21).

31 Claims, No Drawings

THERMAL SENSITIVE RECORDING MEDIUM

FIELD OF THE INVENTION

This invention relates to a thermal sensitive recording medium which has an excellent feature for preservation of a developed image.

DESCRIPTION OF THE PRIOR ART

In general, a thermal sensitive recording medium can be obtained by mixing normally a colorless or pale colored basic leuco dye and a color developer such as a phenolic compound, each dispersed to fine particles and mixed, adding a binder, a filler, a sensitizer, a slip agent, and other additives to form a coating color, and coating the obtained coating color on a substrate such as paper, synthetic paper, films or plastics, which develops color by a momentary chemical reaction caused by heating with a thermal head, a hot stamp, a thermal pen, laser light or the like to obtain a recorded image.

A thermal sensitive recording medium can be applied in a wide variety of fields such as facsimiles, terminal printers for computers, automatic ticket venders and measuring recorders and recently the applications are broadly extended to slips for percel delivery service and bar code labels for foods and others. However, in a conventional dye type thermal sensitive recording medium which coats a thermal sensitive color developing layer composed by an effective component comprising a basic leuco dye, a color developer and a binder on a substrate has been known to have a problem in that the developed image tends to discolor with a time lapse. This discoloration is accelerated by the exposure to light, high temperature or high-humid environment, further, remarkably advanced by immersing in water for a long time, contact with an oil e.g. salad oil or a plasticizer, and the developed image becomes unreadable.

For the purpose to suppress such discoloration of the developed image, various kinds of techniques have been disclosed on thermal sensitive recording media which uses a basic leuco dye mainly composed by a colorless or pale colored lactone ring compound. For instance, a thermal sensitive recording medium comprising a thermal color developing layer in which a phenolic antioxidant is mixed disclosed in Japanese Patent Laid-open Publication 78782/85 or Japanese Patent Laid-open Publication 114096/84, a thermal sensitive recording medium which uses hydrophobic macromolecule compound emulsion is used as a protective layer disclosed in Japanese Patent Laid-open Publication 146794/81 and a thermal sensitive recording medium which uses epoxy compound together with a phenolic color developer disclosed in Japanese Patent Laid-open Publication 164579/87 are known. However, since these techniques are not sufficient for the practical use, a new technique to stabilize a developed image against a time lapse still have been required.

OBJECT OF THE INVENTION

The object of this invention is to improve a thermal sensitive recording medium comprising a basic leuco dye and a phenolic color developer to have an excellent stability, especially the stability to a plasticizer.

BRIEF SUMMARY OF THE INVENTION

The inventors have conduced intensive studies to develop a thermal sensitive recording medium having above mentioned feature, and consequently accomplished the present invention. The inventors succeeded to improve the stability by including the specific stabilizer in a thermal sensitive color developing layer. The present invention relates to a thermal recording medium, namely, in a thermal sensitive recording medium comprising a thermal color developing layer including a colorless or pale colored basic leuco dye and an organic color developer as main compounds on a substrate characterised by the said thermal color developing layer includes 0.01–0.9 parts of aminobenzenesulfonamide derivatives indicated by general formula (I) based on 1 part of color developer and also includes at least one kind of methylolated fatty acid amide indicated by general formula (II) in proportion of 0.01–2 parts based on 1 part of color developer.

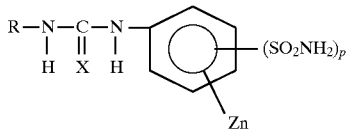

(I)

(in this formula, "X" indicates an oxygen or sulfur atom, "R" indicates non-substituted or substituted phenyl group, naphthyl group, aralkyl group, lower alkyl group of carbon number 1–6, cycloalkyl group of carbon number 3–6 or lower alkenyl group of carbon number 2–6. "Z" indicates lower alkyl group of carbon number 1–6 or electron attractive group. "n" indicates an integer from 0 to 4 and "P" indicates an integral number from 1 to 5, wherein satisfies the numerical formula of $n+p \leqq 5$)

$$R_1\text{—}CONHCH_2OH \qquad \text{(II)}$$

(in this formula "$R_1$" indicates alkyl group of carbon number 11 to 21)

DETAILED DESCRIPTION OF THE INVENTION

In the thermal sensitive color developing layer of this invention, derivatives of aminobenzenesulfonamide indicated by general formula (I) is included. In general formula (I), "X" indicates an oxygen or sulfur atom, and "Z" is a substituted group which does not hurt the function of stabilizer. Concretely, a lower alkyl group of carbon number 1–6 such as methyl group or ethyl group, or electron attractive group such as nitro group or methoxy group can be mentioned as examples of said substituted group. "R" indicates a hydrocarbon group, concretely, phenyl group, aralkyl group, lower alkyl group of carbon number 1–6, cyclo alkyl group of carbon number 3–6, lower alkenyl group of carbon number 2–6 or naphthyl group can be mentioned. And substituted groups which do not hurt the stabilizing effect can be introduced to "R", and as examples of substituted group, a lower alkyl group of carbon number 1–6 such as methyl group or ethyl group, a lower alkenyl group of carbon number 1–6 such as isopropenyl group or electron attractive group such as chlorine atom, nitro group or methoxy group can be mentioned. As the substantial examples of compounds indicated by general formula (I), following compounds from (I-1) to(I-72) can be mentioned, however, it is not intended to be limited to them. The compound of (I-10) is preferably used by the reason of easy purchase and easy synthesis.

(1-1)
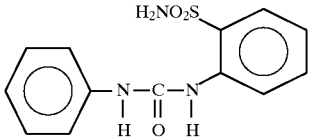
(1-2)
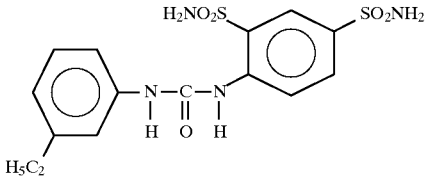
(1-3)
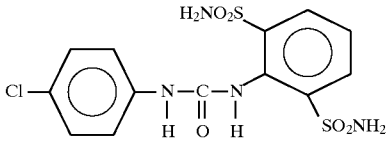
(1-4)
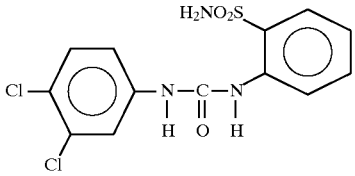
(1-5)
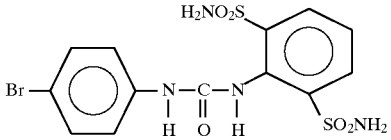
(1-6)
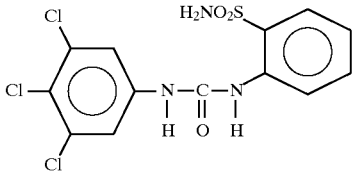
(1-7)
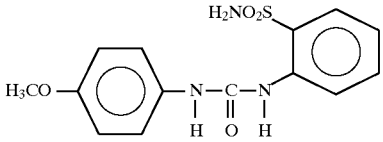
(1-8)
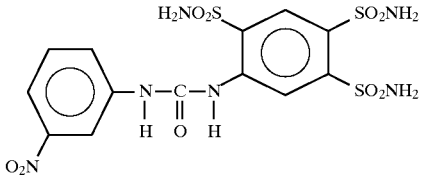
(1-9)
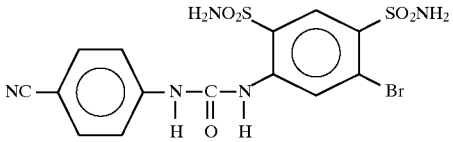
(1-10)
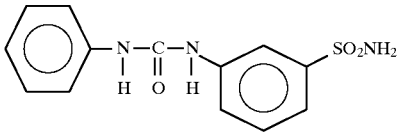
-continued
(1-11)
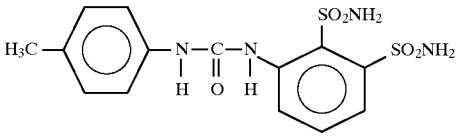
(1-12)
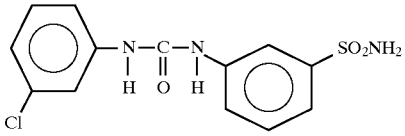
(1-13)
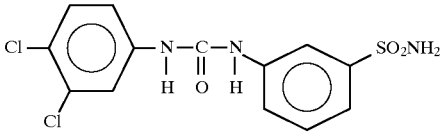
(1-14)
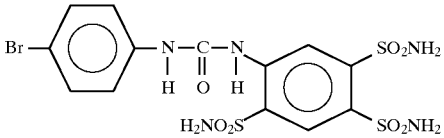
(1-15)
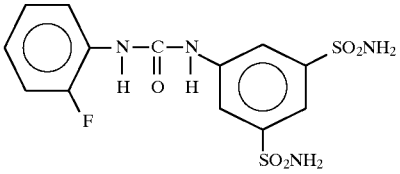
(1-16)
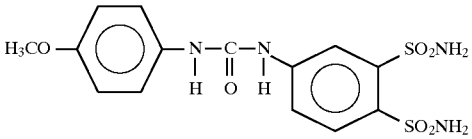
(1-17)
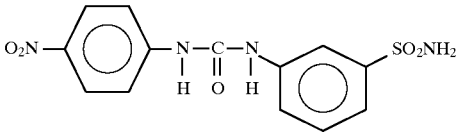
(1-18)
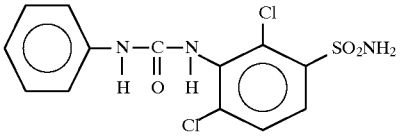
(1-19)
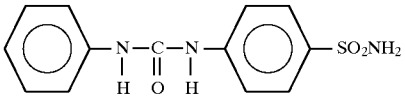
(1-20)
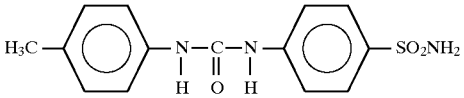
(1-21)
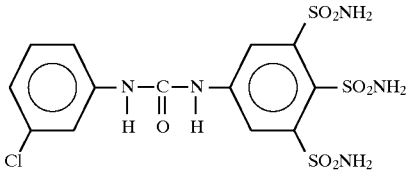

-continued
(1-22)
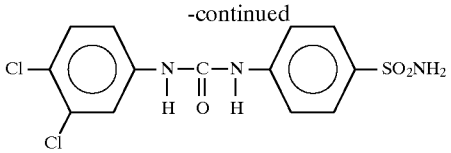
(1-23)
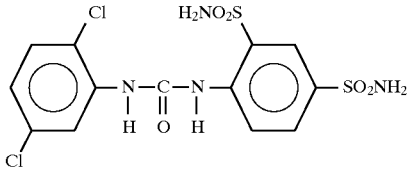
(1-24)
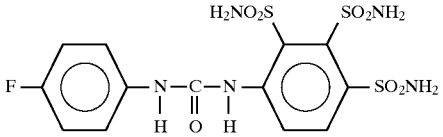
(1-25)
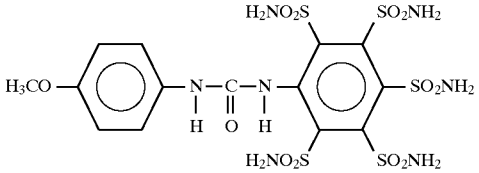
(1-26)
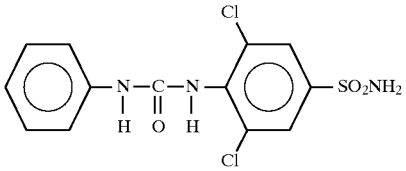
(1-27)
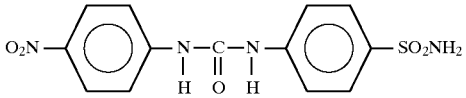
(1-28)
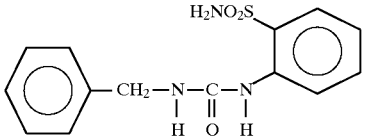
(1-29)
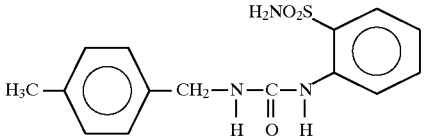
(1-30)
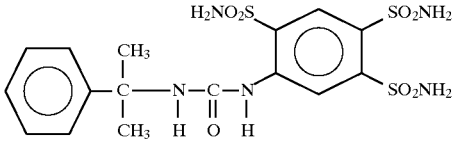
(1-31)
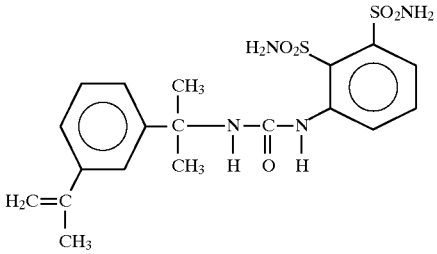
-continued
(1-32)
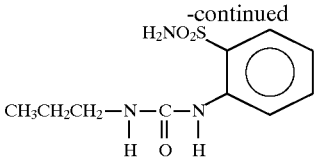
(1-33)
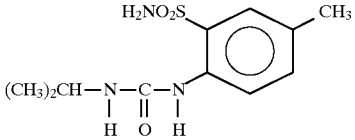
(1-34)
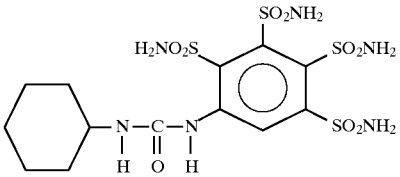
(1-35)
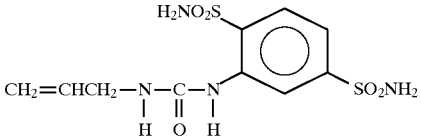
(1-36)
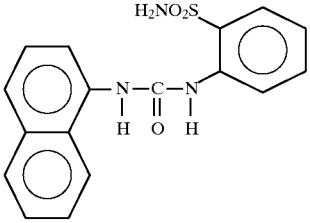
(1-37)
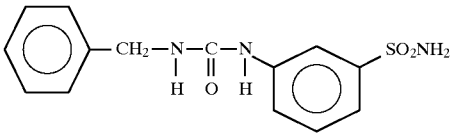
(1-38)
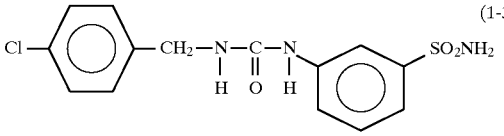
(1-39)
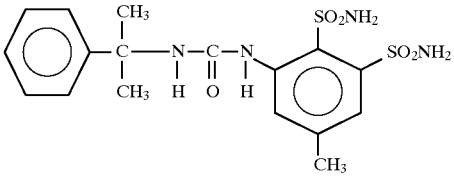
(1-40)
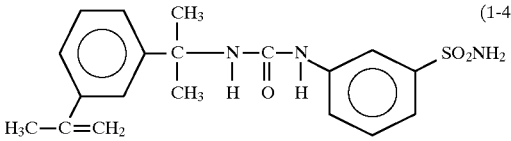
(1-41)
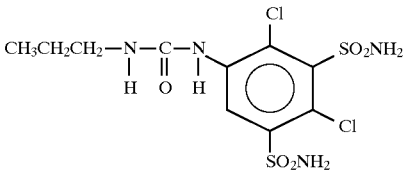

-continued
(1-42)
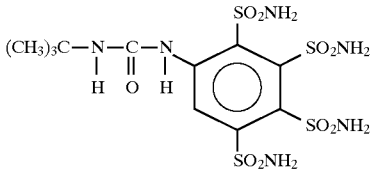
(1-43)
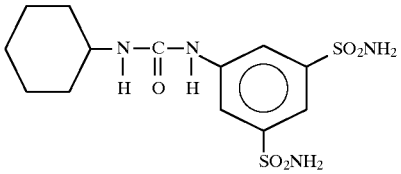
(1-44)
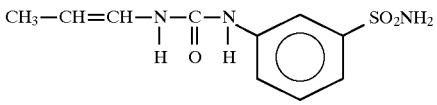
(1-45)
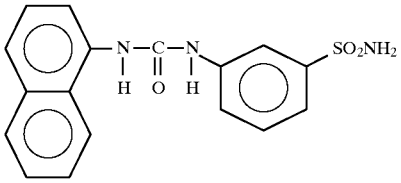
(1-46)
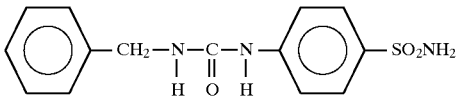
(1-47)
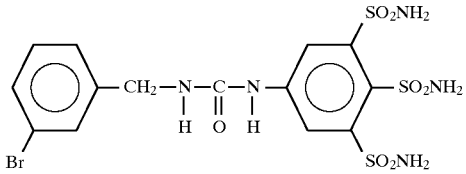
(1-48)
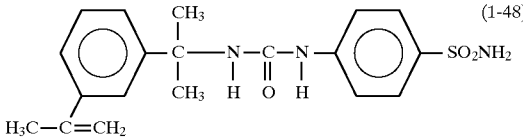
(1-49)
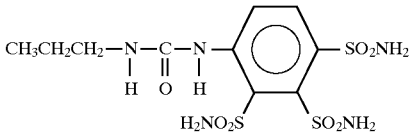
(1-50)
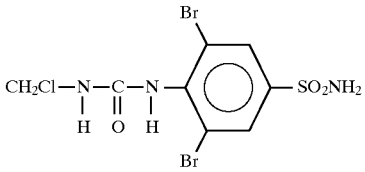
(1-51)
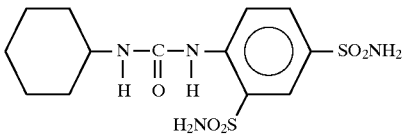
-continued
(1-52)
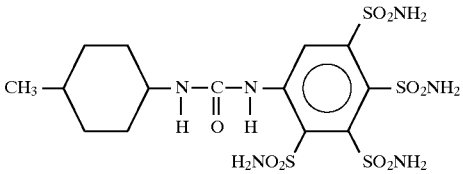
(1-53)
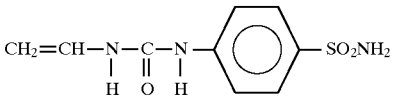
(1-54)
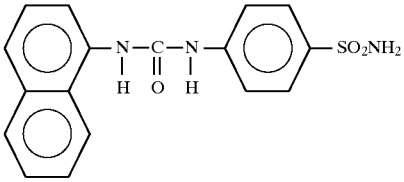
(1-55)
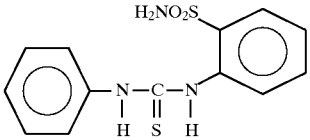
(1-56)
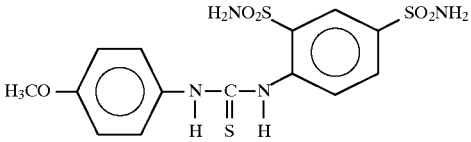
(1-57)
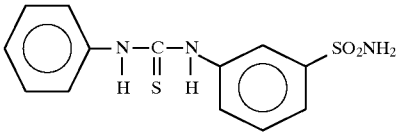
(1-58)
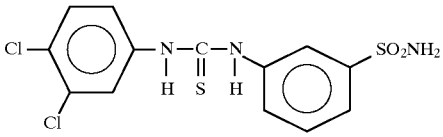
(1-59)
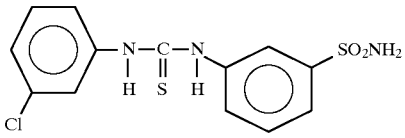
(1-60)
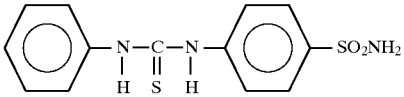
(1-61)
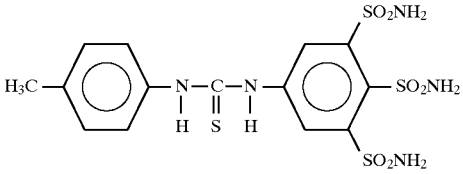

-continued (1-62)

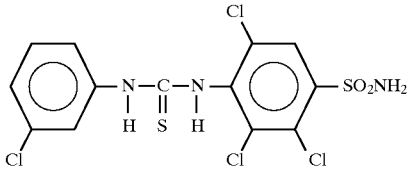

(1-63)

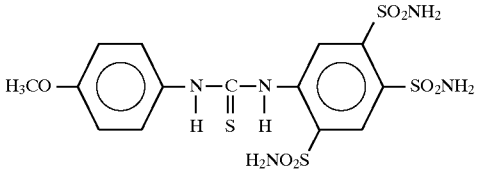

(1-64)

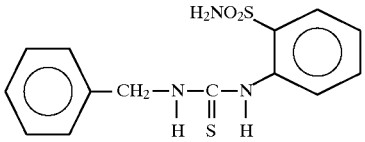

(1-65)

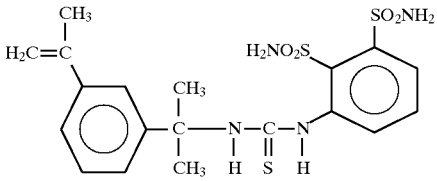

(1-66)

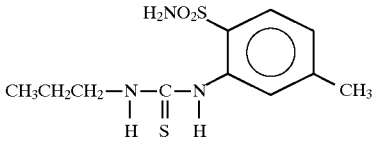

(1-67)

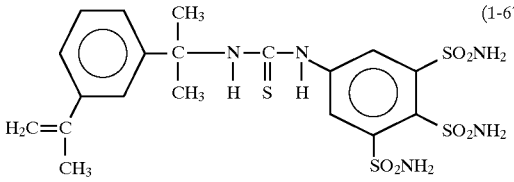

(1-68)

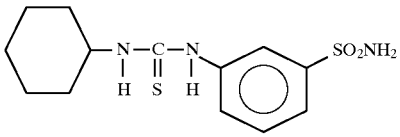

(1-69)

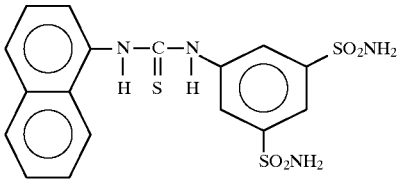

(1-70)

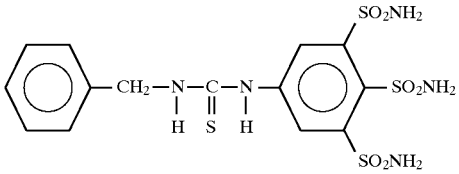

(1-71)

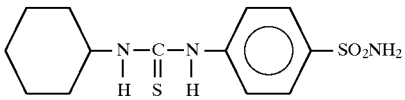

-continued (1-72)

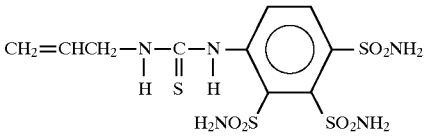

In this invention, if the proportion of derivatives of aminobenzenesulfonamide indicated by general formula (I) is smaller than 0.01 parts based on 1 part of color developer, the sufficient stabilizing effect can not be expected, and if it is bigger than 0.9 parts based on 1 part of color developer, the enough color developing density can not be obtained. Therefore, for the preparation of the thermal sensitive recording medium which can be satisfied at the view point of stabilizing effect and also at the view point of color developing density, it is desirable to use the derivatives of aminobenzenesulfonamide indicated by general formula (I) by the proportion of 0.01–0.9 parts based on 1 part of color developer.

Furthermore, in this invention, at least one kind of methylol fatty acid amide indicated by general formula (II) are included in the thermal sensitive color developing layer with the compound of said general formula (I).

In general formula (II), "$R_1$" indicates hydrocarbon group, concretely alkyl group of carbon number 11 to 21 can be mentioned. As the substantial examples of compounds indicated by general formula (II), following compounds from (II-1) to (II-4) can be mentioned, however, it is not intended to be limited to them. The compound of (II-3) is preferably used by the reason of easy purchase and stabilizing effect when it is used with said compound of (I-10).

$C_{11}H_{23}CONHCH_2OH$ (II-1)

$C_{15}H_{31}CONHCH_2OH$ (II-2)

$C_{17}H_{35}CONHCH_2OH$ (II-3)

$C_{21}H_{43}CONHCH_2OH$ (II-4)

In this invention, if the proportion of methylolated fatty acid amide indicated by general formula (II) is smaller than 0.01 parts based on 1 part of color developer, the sufficient stabilizing effect can not be expected, and if it is bigger than 2 parts based on 1 part of color developer, the enough color developing density can not be obtained. Therefore, for the preparation of the thermal sensitive recording medium which can be satisfied at the view point of stabilizing effect and also at the view point of color developing density, it is desirable to use methylolated fatty acid amide indicated by general formula (II) by the proportion of 0.01–2 parts based on 1 part of color developer.

In this invention, it is obvious that the derivatives of aminobenzenesulfonamide indicated by general formula (I) which is used as a stabilizer is recognized as to have a color developing ability, but it is inferior to that of an ordinary organic color developer. However, by using the compound of general formula (I) in a specific proportion based on 1 part of organic color developer, the compound of general formula (I) can reveal a function of stabilizer. The reason for said phenomenon is not clearly clarified, but guessed as below.

Generally, a thermal recording medium is composed by a basic leuco dye which acts as an electron donor and an organic acid substance which acts as an electron accepter. Electrons are exchanged between said basic leuco dye and color developer by heat fusion, then a kind of complex is formed and a color image can be obtained. The compound of general formula (I) is thought to act as to strengthen the chemical bond between basic leuco dye and color developer and stabilize the recorded image. On the other hand, the compound of general formula (II) is thought to strengthen the interaction between said complex and the compound of general formula (I) when it is mixed by heat fusion with the compound (II). Therefore, in this invention, a thermal sensitive recording medium having high stabilization can be obtained by using a compound of general formula (I) together with that of general formula (II).

As a basic leuco dye used for the thermal recording medium of this invention, every public known compounds in the fields of the conventional pressure sensitive or thermal sensitive recording paper can be used, and preferably triphenylmethane compounds, fluoran compounds, fluorene compounds and divinyl compounds can be used, however not intended to be limited to them. Examples of typical basic leuco dye are indicated below. These basic leuco dyes can be used alone or by mixing with others.

<triphenylmethane-based leuco dye>

3,3-bis(p-dimethylaminophenyl)-6-dimethylaminophthalide [another name is crystal violet lactone]

3,3-bis(p-dimethylaminophenyl)phthalide [another name is malachite green lactone]

<fluoran-based leuco dye>

3-diethylamino-6-methylfluoran
3-diethylamino-6-methyl-7-anilinofluoran
3-diethylamino-6-methyl-7-(o,p-dimethylanilino)fluoran
3-diethylamino-6-methyl-7-chlorofluoran
3-diethylamino-6-methyl-7-(m-trifluoromethylanilino)fluoran
3-diethylamino-6-methyl-7-(o-chloroanilino)fluoran
3-diethylamino-6-methyl-7-(p-chloroanilino)fluoran
3-diethylamino-6-methyl-7-(o-fluoroanilino)fluoran
3-diethylamino-6-methyl-7-n-octylanilinofluoran
3-diethylamino-6-methyl-7-n-octylaminofluoran
3-diethylamino-6-methyl-7-benzylanilinofluoran
3-diethylamino-6-methyl-7-dibenzylanilinofluoran
3-diethylamino-6-chloro-7-methylfluoran
3-diethylamino-6-chloro-7-anilinofluoran
3-diethylamino-6-chloro-7-p-methylanilinofluoran
3-diethylamino-6-ethoxyethyl-7-anilinofluoran
3-diethyl amino-7-methylfluoran
3-diethylamino-7-chlorofluoran
3-diethylamino-7-(m-trifluoromethylanilino)fluoran
3-diethylamino-7-(o-chloroanilino)fluoran
3-diethylamino-7-(p-chloroanilino)fluoran
3-diethylamino-7-(o-fluoroanilino)fluoran
3-diethylamino-benzo[a]fluoran
3-diethylamino-benzo[c]fluoran
3-dibutylamino-6-methyl-fluoran
3-dibutylamino-6-methyl-7-anilinofluoran
3-dibutylamino-6-methyl-7-(o,p-dimethylanilino)fluoran
3-dibutylamino-6-methyl-7-(o-chloroanilino)fluoran
3-dibutylamino-6-methyl-7-(p-chloroanilino)fluoran
3-dibutylamino-6-methyl-7-(o-fluoroanilino)fluoran
3-dibutylamino-6-methyl-7-(m-trifluoromethylanilino)fluoran
3-dibutylamino-6-methyl-chlorofluoran
3-dibutylamino-6-ethoxyethyl-7-anilinofluoran
3-dibutylamino-6-chloro-7-anilinofluoran
3-dibutylamino-6-methyl-7-p-methylanilinofluoran
3-dibutylamino-7-(o-chloroanilino)fluoran
3-dibutylamino-7-(o-fluoroanilino)fluoran
3-n-dipentylamino-6-methyl-7-anilinofluoran
3-n-dipentylamino-6-methyl-7-(p-chloroanilino)fluoran
3-n-dipentylamino-7-(m-trifluoromethylanilino)fluoran
3-n-dipentylamino-6-chloro-7-anilinofluoran
3-n-dipentylamino-7-(p-chloroanilino)fluoran
3-pyrrolidino-6-methyl-7-anilinofluoran
3-pyperidino-6-methyl-7-anilinofluoran
3-(N-methyl-N-propylamino)-6-methyl-7-anilinofluoran
3-(N-methyl-N-cyclohexylamino)-6-methyl-7-anilinofluoran
3-(N-ethyl-N-cyclohexylamino)-6-methyl-7-anilinofluoran
3-(N-ethyl-N-xylamino)-6-methyl-7-(p-chloroanilino)fluoran
3-(N-ethyl-p-toluidino)-6-methyl-7-anilinofluoran
3-(N-ethyl-N-isoamylamino)-6-methyl-7-anilinofluoran
3-(N-ethyl-N-isoamylamino)-6-chloro-7-anilinofluoran
3-(N-ethyl-N-tetrahydrofurfurylamino)-6-methyl-7-anilinofluoran
3-(N-ethyl-N-isobutylamino)-6-methyl-7-anilinofluoran
3-(N-ethyl-N-ethoxypropylamino)-6-methyl-7-anilinofluoran
3-cyclohexylamino-6-chlorofluoran
2-(4-oxahexyl)-3-dimethylamino-6-methyl-7-anilinofluoran
2-(4-oxahexyl)-3-diethylamino-6-methyl-7-anilinofluoran
2-(4-oxahexyl)-3-dipropylamino-6-methyl-7-anilinofluoran
2-methyl-6-p-(p-dimethylaminophenyl)aminoanilinofluoran
2-methoxy-6-p-(p-dimethylaminophenyl)aminoanilinofluoran
2-chloro-3-methyl-6-p-(p-phenylaminophenyl)aminoanilinofluoran
2-chloro-6-p-(p-dimethylaminophenyl)aminoanilinofluoran
2-nitro-6-p-(p-diethylaminophenyl)aminoanilinofluoran
2-amino-6-p-(p-diethylaminophenyl)aminoanilinofluoran
2-diethylamino-6-p-(p-diethylaminophenyl)aminoanilinofluoran
2-phenyl-6-methyl-6-p-(p-phenylaminophenyl)aminoanilinofluoran
2-benzyl-6-p-(p-phenylaminophenyl)aminoanilinofluoran
2-hydroxy-6-p-(p-phenylaminophenyl)aminoanilinofluoran
3-methyl-6-p-(p-dimethylaminophenyl)aminoanilinofluoran
3-diethylamino-6-p-(p-diethylaminophenyl)aminoanilinofluoran
3-diethylamino-6-p-(p-dibutylaminophenyl)aminoanilinofluoran
2,4-dimethyl-6-[(4-dimethylamino)anilino]-fluoran <fluorene-based leuco dye>

3,6,6'-tris(dimethylamino)spiro[fluorene-9,3'-phthalide]
3,6,6'-tris(diethylamino)spiro[fluorene-9,3'-phthalide]

<divinyl-based leuco dye>

3,3-bis-[2-(p-dimethylaminophenyl)-2-(p-methoxyphenyl)ethenyl]-4,5,6,7-tetrabromophthalide
3,3-bis-[2-(p-dimethylaminophenyl)-2-(p-methoxyphenyl)ethenyl]-4,5,6,7-tetrachlorophthalide
3,3-bis-[1,1-bis(4-pyrrolidinophenyl)ethylene-2-yl]-4,5,6,7-tetrabromophthalide 3,3-bis-[1-(4-methoxyphenyl)-1-(4-pyrrolidinophenyl)ethylene-2-yl]-4,5,6,7-tetrachlorophthalide <others>

3-(4-diethylamino-2-ethoxyphenyl)-3-(1-ethyl-2-methylindole-3-yl)-4-azaphthalide
3-(4-diethylamino-2-ethoxyphenyl)-3-(1-octyl-2-methylindole-3-yl)-4-azaphthalide
3-(4-cyclohexylethylamino-2-methoxyphenyl)-3-(1-ethyl-2-methylindole-3-yl)-4-azaphthalide
3,3-bis(1-ethyl-2-methylindole-3-yl)phthalide 3,6-bis(diethylamino)fluoran-γ-(3'-nitro)anilinolactam 3,6-bis(diethylamino)fluoran-γ-(4'-nitro)anilinolactam
1,1-bis-[2', 2', 2", 2"-tetrakis-(p-dimethylaminophenyl)-ethenyl]-2,2-dinitrilethane 1,1-bis-[2', 2', 2", 2"-tetrakis-(p-dimethylaminophenyl)-ethenyl]-2-β-naphthoylethane
1,1-bis-[2', 2', 2", 2"-tetrakis-(p-dimethylaminophenyl)-ethenyl]-2,2-diacetylethane
bis-[2,2,2', 2'-tetrakis-(p-dimethylaminophenyl)-ethenyl]-methymalonatedimethyl ester In this invention, an effect by a difference of the kind of basic leuco dye to the stability of image is not so remarkable, but gives a slight difference. The reason for said phenomenon is not clarified, however, it is considered that because the stability of developed image is almost depended to the polarity of basic leuco dye (it can be detected by the developed state of thin-layer chromatography). For instance, the polarity of 3-diethylamino-6-methyl-7-anilinofluoran is relatively high, and in comparison with said compound the polarity of 3-(N-ethyl-N-isoamylamino)-6-methyl-7-anilinofluoran or 3-dibuthylamino-6-methyl-7-anilinofluoran is low. It is considered that the developed image is depends on the reactivity between these basic leuco dye and color developer, and the said fact participate in the stabilization, further influences to the solubility with plasicizer. However, when the basic leuco dye having high polarity is used, it has a high reactivity with developer and have a possibility to cause a problem of coloration of ground color. And, a plasicizer resistance is improved by mixing use of basic leuco dye. Also the reason for said phenomenon is not clearly clarified, however, it is presumed that because the electron transfer complex forms a strong reactive substance in comparison with the case using basic leuco dye alone.

As the substantial examples of an organic color developer used in a thermal sensitive recording medium of this invention, for instance, following compounds which are disclosed in Japanese Patent Laid-open Publication 207688/91, or in Japanese Patent Laid-open Publication 24366/93 can be mentioned:

bisphenol A type
4-hydroxybenzoic ester type
4-hydroxyphthalic diester type
phthalic monoester bis-(hydroxyphenyl)sulfide type
4-hydroxyphenylarylsulfone type
4-hydroxyphenylarylsulfonate type
1,3-di[2-(hydroxyphenyl)-2-propyl]-benzene type
4-hydroxybenzoiloxybenzoic ester type
bisphenolsulfone type Substantial examples of typical public known developer are indicated below, however, not intended to be limited to them. These developer can be used alone or can be used by mixing with others.

<bisphenol A type>
4,4'-isopropylidenediphenol(another name is bisphenol A)
4,4'-cyclohexylidenediphenol
p,p'-(1-methyl-normalhexylidene)diphenol
1,7-di(hydroxyphenylthio)-3,5-dioxaheptane
<4-hydroxybenzoic ester type>
4-hydroxybenzylbenzoate
4-hydroxyethylbenzoate
4-hydroxypropylbenzoate
4-hydroxyisopropylbenzoate
4-hydroxybutylbenzoate
4-hydroxyisobutylbenzoate
4-hydroxymethylbenzylbenzoate
<4-hydroxyphthalic diester type>
4-hydroxydimethylphthalate
4-hydroxydiisopropylphthalate
4-hydroxydibenzylphthalate
4-hydroxydihexylphthalate
<phthalic monoester type>
monobenzylphthalate ester
monocyclohexylphthalate ester
monophenylphthalate ester
monomethylphenylphthalate ester
monomethylphenylphthalate ester
monopropylbenzylphthalate ester
monohalogenbenzylphthalate ester
monoethoxybenzylphthalate ester
<bis-(hydroxyphenyl)sulfide type>
bis-(4-hydroxy-3-tert-butyl-6-methylphenyl)sulfide
bis-(4-hydroxy-2,5-dimethylphenyl)sulfide
bis-(4-hydroxy-2-methyl-5-ethylphenyl)sulfide
bis-(4-hydroxy-2-methyl-5-isopropylphenyl)sulfide
bis-(4-hydroxy-2,3-dimethylphenyl)sulfide
bis-(4-hydroxy-2,5-dimethylphenyl)sulfide
bis-(4-hydroxy-2,5-diisopropylphenyl)sulfide
bis-(4-hydroxy-2,3,6-trimethylphenyl)sulfide
bis-(2,4,5-trihydroxyphenyl)sulfide
bis-(4-hydroxy-2-cyclohexyl-5-methylphenyl)sulfide
bis-(2,3,4-trihydroxyphenyl)sulfide
bis-(4,5-dihydroxy-2-tert-butylphenyl)sulfide
bis-(4-hydroxy-2,5-diphenylphenyl)sulfide
bis-(4-hydroxy-2-tert-octyl-5-methylphenyl)sulfide
<4-hydroxyphenylarylsulfone type>
4-hydroxy-4'-isopropoxydiphenylsulfone
4-hydroxy-4'-propoxydiphenylsulfone
4-hydroxy-4'-n-butyloxydiphenylsulfone
4-hydroxy-4'-n-propoxydiphenylsulfone
<4-hydroxyphenylarylsulfonate type>
4-hydroxyphenylbenzenesulfonate
4-hydroxyphenyl-p-tolylsulfonate
4-hydroxyphenylmethylenesulfonate
4-hydroxyphenyl-p-chlorobenzenesulfonate
4-hydroxyphenyl-p-tert-butylbenzenesulfonate
4-hydroxyphenyl-p-isopropoxybenzenesulfonate
4-hydroxyphenyl-1'-naphthalenesulfonate
4-hydroxyphenyl-2'-naphthalenesulfonate
<1,3-di[2-(hydroxyphenyl)-2-propyl]-benzene type>
1,3-di[2-(4-hydroxyphenyl)-2-propyl]benzene
1,3-di[2-(4-hydroxy-3-alkylphenyl)-2-propyl]benzene
1,3-di[2-(2,4-dihydroxyphenyl)-2-propyl]benzene
1,3-di[2-(2-hydroxy-5-methylphenyl)-2-propyl]benzene
<resorcinol type>
1,3-dihydroxy-6(α,α-dimethylbenzyl)-benzene
<4-hydroxybenzoiloxybenzoic ester type>
4-hydroxybenzoiloxybenzylbenzoate
4-hydroxybenzoiloxymethylbenzoate
4-hydroxybenzoiloxyethylbenzoate
4-hydroxybenzoiloxypropylbenzoate
4-hydroxybenzoiloxybutylbenzoate
4-hydroxybenzoiloxyisopropylbenzoate
4-hydroxybenzoiloxytert-butylbenzoate
4-hydroxybenzoiloxyhexylbenzoate
4-hydroxybenzoiloxyoctylbenzoate
4-hydroxybenzoiloxynonylbenzoate
4-hydroxybenzoiloxycyclohexylbenzoate
4-hydroxybenzoiloxyβ-phenethylbenzoate
4-hydroxybenzoiloxyphenylbenzoate
4-hydroxybenzoiloxyα-naphthylbenzoate
4-hydroxybenzoiloxyβ-naphthylbenzoate
4-hydroxybenzoiloxysec-butylbenzoate
<bisphenolsulfone type (I)>
bis-(3-1-butyl-4-hydroxy-6-methylphenyl)sulfone
bis-(3-ethyl-4-hydroxyphenyl)sulfone
bis-(3-propyl-4-hydroxyphenyl)sulfone
bis-(3-methyl-4-hydroxyphenyl)sulfone bis-(2-isopropyl-4-hydroxyphenyl)sulfone
bis-(2-ethyl-4-hydroxyphenyl)sulfone
bis-(3-chloro-4-hydroxyphenyl)sulfone
bis-(2,3-dimethyl-4-hydroxyphenyl)sulfone
bis-(2,5-dimethyl-4-hydroxyphenyl)sulfone
bis-(3-methoxy-4-hydroxyphenyl)sulfone
4-hydroxyphenyl-2'-ethyl-4'-hydroxyphenylsulfone
4-hydroxyphenyl-2'-isopropyl-4'-hydroxyphenylsulfone
4-hydroxyphenyl-3'-isopropyl-4'-hydroxyphenylsulfone
4-hydroxyphenyl-3'-secbutyl-4'-hydroxyphenylsulfone
3-chloro-4-hydroxyphenyl-3'-isopropyl-4'-hydroxyphenylsulfone
2-hydroxy-5-t-butylphenyl-4'-hydroxyphenylsulfone
2-hydroxy-5-t-aminophenyl-4'-hydroxyphenylsulfone
2-hydroxy-5-t-isopropylphenyl-4'-hydroxyphenylsulfone
2-hydroxy-5-t-octylphenyl-4'-hydroxyphenylsulfone
2-hydroxy-5-t-butylphenyl-3'-chloro-4'-hydroxyphenylsulfone
2-hydroxy-5-t-butylphenyl-3'-methyl-4'-hydroxyphenylsulfone
2-hydroxy-5-t-butylphenyl-3'-isopropyl-4'-hydroxyphenylsulfone
2-hydroxy-5-t-butylphenyl-3'-chloro-4'-hydroxyphenylsulfone
2-hydroxy-5-t-butylphenyl-3'-methyl-4'-hydroxyphenylsulfone
2-hydroxy-5-t-butylphenyl-3'-isopropyl-4'-hydroxyphenylsulfone
2-hydroxy-5-t-butylphenyl-2'-methyl-4'-hydroxyphenylsulfone
<bisphenolsulfone type (II)>
4,4'-sulfonyldiphenol
2,4'-sulfonyldiphenol
3,3'-dichloro-4,4'-sulfonyldiphenol
3,3'-dibromo-4,4'-sulfonyldiphenol
3,3',5,5'-tetrabromo-4,4'-sulfonyldiphenol
3,3'-diamino-4,4'-sulfonyldiphenol
<others>
p-tert-butylphenol
2,4-dihydroxybenzophenone
novolak type phenol resin
4-hydroxyacetophenone
p-phenylphenol
benzyl-4-hydroxyphenylacetate
p-benzylphenol In this invention, since the developer having plural phenolic hydroxyl groups have a tendency to progress ground color contamination (coloration of ground color) when it is coated as aqueous solution or by the influence of humidity contained in atmosphere, a developer of mono-phenolic compound is desirably used to obtain a better ground color stabilization. Especially, above mentioned mono-phenolic sulfone developer represented by 4-hydroxyphenylarylsulfonate includes sulfonyl group in it's structure. A strong electron accepted portion is formed by an electron attractive effect of this sulfonyl group, indicates strong reactivity with basic leuco dye and performs an excellent color developing ability, further the obtained thermal recordring medium is also superior to the stability of ground color.

In this invention, the conventional public known sensitizer can be used as far as it does not hurt the necessary effects referring to the above mentioned object. As the substantial example of the sensitizer, following compounds can be mentioned, however, not intended to be limited to them. These sensitizer can be used alone or can be used by mixing with others.

montanic acid wax
polyethylene wax
1,2-di-(3-methylphenoxy)ethane
p-benzylbiphenyl
β-benzyloxynaphthalene
4-biphenyl-p-tolyleter
m-tarphenyl
1,2-diphenoxyethane
dibenzyloxalate
di(p-chlorobenzyl)oxalate
di(p-methylbenzyl)oxalate
dibenzylterephthalate
p-benzyloxybenzylbenzoate
di-p-tolylcarbonate
phenyl-α-naphthylcarbonate
1,4-diethoxynaphthalene
1-hydroxy-2-naphthoeic acid phenyl ester
o-xylylene-bis-(phenylether)
4-(m-methylphenoxymethyl)biphenyl As the binder to be used in this invention, full saponificated polyvinyl alcohol having 200–1900 polimerization degree, partially saponificated polyvinylalcohol, denatured polyvinylalcohol such as denatured polyvinylalcohol by carboxy, denatured polyvinylalcohol by amide, denatured polyvinylalcohol by sulfonic acid and denatured polyvinylalcohol by buthylal, derivatives of cellulose such as hydroxyethyl cellulose, methyl cellulose, ethyl cellulose, carboxymethyl cellulose and acethyl cellulose, copolymer of styrene-maleic anhydryde, copolymer of styrene-buthadien, polyvinylchrolide, polyvinyl acetate, polyacrylicamide, polyacrylicester, polyvinylbuthylal, polystyrene and copolymer of these polymers, polyamide resin, silicon resin, petroleum resin, terpene resin, ketone resin, cumarone resin can be mentioned. These kinds of macromolecule compound can be used by dissolving in water or in solvents such as alcohol, ketone, ester of hydrocarbon, and also can be used by dispersing it by emulsion or paste state in water or other solvent. These methods can be used in combination with, if necessary.

In this invention, it is possible to add metallic salt (Ca, Zn) of p-nitorobenzoic acid, or metallic salt (Ca, Zn) of monobenzylphthalate or derivatives of diphenylsulfone which is a public known stabilizer having a good effect for oil resistance of the recording image, within a limit in so far as not hurting the necessary effects referring to the above mentioned object.

As a filler which can be used in this invention, following inorganic or organic compounds can be mentioned namely, silica, calcium carbonate, kaoline, calcined kaoline, diatomaceous earth, talc, titanium oxide, zinc oxide, aluminium hydroxide, polystyrene resin, urea-formaldehyde resin, styrene-methacrylic acid copolymer, styrene-buthadiene copolymer, hollow plastic pigment, and the like.

Further, a parting compounds such as metallic salt of fatty acid, lubricants such as wax, ultra violet lay absorbers such as benzophenon group or triazol group, waterproof agents such as glyoxal, dispersing agents, deformers, antioxidants and fluorescent dyes can be used.

As a substrate, paper, synthetic paper, plastic film, non-woven cloth or metal foil can be used, further a hybrid sheet which is prepared by assembling these materials.

And, for the purpose to increase the preservability it is possible to prepare an over coating layer composed by macromolecule compound or others on the thermal sensitive color developing layer. Further, for the purpose to increase the preservability and sensitivity, it is possible to prepare an undercoat layer between a color developing layer and a substrate.

EXAMPLES OF THE INVENTION

The present invention will be more clearly understood with reference to the following Examples.

The thermal sensitive recording medium of this invention can be obtained by following procedure, that is; prepare the coating color of thermal sensitive color developing layer by dispersing a basic leuco dye, a color developer, one or more kinds of aminobenzenesulfonamide derivative indicated by above mentioned general formula (I) as a stabilizer and also one or more kinds of methylol fatty acid amide indicated by above mentioned general formula (II) as a stabilizer are severally dispersed with a binder, then a filler and other additives are added as necessary. The coating color is coated on the substrate and dried up, thus the thermal sensitive recording medium can be obtained.

The type and the amount of a developer, a basic leuco dye and other additives are decided according to the required features and to the recording property of the thermal sensitive recording medium, and in general preferable amount of these compounds are follows, however, are not intended to be limited. That is, 0.1–2 parts of dye and 0.5–4 parts of filler based on 1 part of organic developer. The preferable amount of binder is 5–25% to the total amount of solid. And the compound indicated by general formula (I) is used by the proportion of 0.01–0.9 part based on 1 part of developer, and the compound indicated by general formula (II) is used by the proportion of 0.01–2 parts based on 1 part of developer.

These developer, dye and other additives to be added as necessary are ground to the fine particles of micron size level by means of a pulverizer such as a ball mill, an attritor or a sand grinder or an adequate emulsifying apparatus, and binder and other additives are added in accordance with the necessity, thus the coating color is prepared. As the coating method, a hand coating method, a sizing press coater method, a roll coater method, an air knife coater method, a blend coater method, a flow coater method, a comma direct method, a gravure direct method, a gravure reverse method or a reverse-roll coater method can be mentioned. Or, it is possible to dry up after sprayed, blown or immersed.

EXAMPLES

<preparation of thermal sensitive recording medium>

The present invention is further illustrated by following Examples. In the Examples and Comparative examples, the term of "parts" and "%" means "parts by weight" and "Weight %", unless special provision.

EXAMPLE 1

Example 1 is an experimental result which use 4-hydroxy-4'-isopropoxydiphenylsulfone (D-8) as a developer, 3-(N-ethyl-N-isoamylamino)-6-methyl-7-anilinofluoran (S-205) as a basic leuco dye and compound (I-10) and (II-3) as a stabilizer in the thermal sensitive recording medium of the present invention.

The dispersion of color developer (solution A), the dispersion of basic leuco dye (solution B) and the dispersion of sensitizer (solution C) are separately ground to average diameter of 1 $\mu$m in wet condition by means of a sand grinder.

| Solution A (dispersion of color developer) | |
|---|---|
| 4-hydroxy-4'-isopropoxydiphenylsulfone (D-8) | 6.0 parts |
| 10% polyvinylalcohol aqueous solution | 18.8 parts |
| water | 11.2 parts |

-continued

| Solution B (dispersion of dye) | |
|---|---|
| 3-(N-ethyl-N-isoamylamino)-6-methyl-7-anilinofluoran (S-205) | 2.0 parts |
| 10% polyvinylalcohol aqueous solution | 4.6 parts |
| water | 2.6 parts |
| Solution C (dispersion of stabilizer) | |
| compound (I-10) | 4.0 parts |
| 10% polyvinylalcohol aqueous solution | 18.8 parts |
| water | 11.2 parts |
| Solution D (dispersion of stabilizer) | |
| compound (II-3) | 4.0 parts |
| 10% polyvinylalcohol aqueous solution | 18.8 parts |
| water | 11.2 parts |

Then the resulting dispersion are mixed together in the proportion below so as to prepare the coating color.

| | |
|---|---|
| Solution A (dispersion of color developer [D-8]) | 36.0 parts |
| Solution B (dispersion of basic leuco dye [S-205]) | 9.2 parts |
| Solution C (dispersion of stabilizer [compound (I-10)] | 34.0 parts |
| Solution D (dispersion of stabilizer [compound (II-3)] | 34.0 parts |
| Kaoline clay (50% dispersion) | 12.0 parts |

The prepared coating colors are applied to one side of 50 g/m$^2$ sheet substrate, then dried up and the sheet is processed by a super calender to surface smoothness of 500–600 second. Thus, the thermal sensitive recording medium in a coating weight of 6.0 g/m$^2$ is obtained.

EXAMPLE 2

The thermal sensitive recording paper is prepared like Example 1. In the preparation of solution A, 4,4'-isopropylidenediphenol (bisphenol A, briefly mentioned as BPA in tables) is used instead of 4-hydroxy-4'-isopropoxydiphenylsulfone (D-8).

EXAMPLE 3

The thermal sensitive recording paper is prepared like Example 1. In this Example, two types of color developer are used, that is, 4,4'-isopropylidenediphenol (bisphenol A) and 4-hydroxy-4'-isopropoxydiphenylsulfone (D-8) are used. Each dispersion is mixed and stirred as follows, and the coating color is prepared.

| | |
|---|---|
| Solution A (dispersion of color developer [bisphenol-A]) | 18.0 parts |
| Solution A (dispersion of color developer [D-8]) | 18.0 parts |
| Solution B (dispersion of basic leuco dye [S-205]) | 9.2 parts |
| Solution C (dispersion of stabilizer [compound (I-10)] | 34.0 parts |
| Solution D (dispersion of stabilizer [compound (II-3)] | 34.0 parts |
| Kaoline clay (50% dispersion) | 12.0 parts |

EXAMPLE 4–7

The thermal sensitive recording paper is prepared like Example 1. In the preparation of solution B, 3-dibuthylamino-6-methyl-7-anilinofluoran (ODB-2; Example 4), 3-diethylamino-6-methyl-7-anilinofluoran (ODB ; Example 5), 3-pyrrolidino-6-methyl-7-anilinofluoran (PSD-170; Example 6) and 3,3-bis(p-dimethylaminophenyl)-6-dimethylamino-phthalide (CVL; Example 7) are used instead of 3-(N-ethyl-N-isoamylamino)-6-methyl-7-anilinofluoran (S-205).

EXAMPLE 8

The thermal sensitive recording paper is prepared like Example 1. As the dye, 3-(N-ethyl-N-isoamylamino)-6-methyl-7-anilinofluoran (S-205) and 3-dibuthylamino-6-methyl-7-anilinofluoran (ODB-2) are used. Each dispersion is mixed and stirred as follows, and the coating color is prepared.

| | |
|---|---|
| Solution A (dispersion of color developer [D-8]) | 36.0 parts |
| Solution B (dispersion of basic leuco dye [S-205]) | 4.6 parts |
| Solution B (dispersion of basic leuco dye [OBD-2]) | 4.6 parts |
| Solution C (dispersion of stabilizer [compound (I-10)] | 34.0 parts |
| Solution D (dispersion of stabilizer [compound (II-3)] | 34.0 parts |
| Kaoline clay (50% dispersion) | 12.0 parts |

EXAMPLE 9–12

The thermal sensitive recording paper is prepared like Example 8. In the preparation of solution C, compound (I-1), (I-13), (I-19) and (I-26) are used instead of compound (I-10).

EXAMPLE 13

The thermal sensitive recording paper is prepared like Example 8. In the preparation of solution C, compound (I-10) and (I-1) are used as the stabilizer. Each dispersion is mixed and stirred as follows, and the coating color is prepared.

| | |
|---|---|
| Solution A (dispersion of color developer [D-8]) | 36.0 parts |
| Solution B (dispersion of basic leuco dye [S-205]) | 9.2 parts |
| Solution C (dispersion of stabilizer [compound (I-1)] | 17.0 parts |
| Solution C (dispersion of stabilizer [compound (I-10)] | 17.0 parts |
| Solution D (dispersion of stabilizer [compound (II-3)] | 34.0 parts |
| Kaoline clay (50% dispersion) | 12.0 parts |

EXAMPLE 14

The thermal sensitive recording paper is prepared like Example 8. In the preparation of solution D, compound (II-4) is used instead of (II-3).

EXAMPLE 15

The thermal sensitive recording paper is prepared like Example 8. In the preparation of solution D, compound (II-3) and (II-4) are used as the stabilizer. Each dispersion is mixed and stirred as follows, and the coating color is prepared.

| | |
|---|---|
| Solution A (dispersion of color developer [D-8]) | 36.0 parts |
| Solution B (dispersion of basic leuco dye [S-205]) | 9.2 parts |
| Solution C (dispersion of stabilizer [compound (I-10)] | 34.0 parts |
| Solution D (dispersion of stabilizer [compound (II-3)] | 17.0 parts |
| Solution D (dispersion of stabilizer [compound (II-4)] | 17.0 parts |
| Kaoline clay (50% dispersion) | 12.0 parts |

Comparative Example 1

The thermal sensitive recording paper is prepared like Example 1. However, in the preparation of the color developing layer, solution C and D are not mixed.

Comparative Example 2

The thermal sensitive recording paper is prepared like Example 8. However, in the preparation of the color developing layer, solution C and D are not mixed.

Comparative Example 3

The thermal sensitive recording paper is prepared like Example 8. However, in the preparation of the color developing layer, solution D is not mixed.

Comparative Example 4

The thermal sensitive recording paper is prepared like Example 8. However, in the preparation of the color developing layer, solution C is not mixed.

Comparative Example 5

The thermal sensitive recording paper is prepared like Example 15. However, in the preparation of the color developing layer, solution C is not mixed.

Comparative Example 6

The thermal sensitive recording paper is prepared like Example 8. In the preparation of the color developing layer, solution C is prepared as follows.

| | |
|---|---|
| Solution C' (dispersion of stabilizer) compound (I-10) | 0.030 parts |
| 10% polyvinylalcohol aqueous solution | 0.141 parts |
| water | 0.084 parts |

Then, each dispersion is mixed and stirred as follows, and the coating color is prepared.

| | |
|---|---|
| Solution A (dispersion of color developer [D-8]) | 36.0 parts |
| Solution B (dispersion of basic leuco dye [S-205]) | 4.6 parts |
| Solution B (dispersion of basic leuco dye [ODB-2]) | 4.6 parts |
| Solution C' (dispersion of stabilizer [compound (I-10)] | 0.255 parts |
| Solution D (dispersion of stabilizer [compound (II-3)] | 34.0 parts |
| Kaoline clay (50% dispersion) | 12.0 parts |

Comparative Example 7

The thermal sensitive recording paper is prepared like Example 8. In the preparation of the color developing layer, solution D is prepared as follows.

| | |
|---|---|
| Solution D' (dispersion of stabilizer) compound (II-3) | 0.030 parts |
| 10% polyvinylalcohol aqueous solution | 0.141 parts |
| water | 0.084 parts |

Then, each dispersion is mixed and stirred as follows, and the coating color is prepared.

| | |
|---|---|
| Solution A (dispersion of color developer [D-8]) | 36.0 parts |
| Solution B (dispersion of basic leuco dye [S-205]) | 4.6 parts |
| Solution B (dispersion of basic leuco dye [ODB-2]) | 4.6 parts |
| Solution C (dispersion of stabilizer [compound (I-10)] | 17.0 parts |
| Solution D' (dispersion of stabilizer [compound (II-3)] | 0.255 parts |
| Kaoline clay (50% dispersion) | 12.0 parts |

Comparative Example 8

The thermal sensitive recording paper is prepared like Example 8. In the preparation of the color developing layer, solution C is prepared as follows.

| | |
|---|---|
| Solution C" (dispersion of stabilizer) compound (I-10) | 9.0 parts |
| 10% polyvinylalcohol aqueous solution | 42.3 parts |
| water | 25.2 parts |

Then, each dispersion is mixed and stirred as follows, and the coating color is prepared.

| | |
|---|---|
| Solution A (dispersion of color developer [D-8]) | 36.0 parts |
| Solution B (dispersion of basic leuco dye [S-205]) | 4.6 parts |
| Solution B (dispersion of basic leuco dye [ODB-2]) | 4.6 parts |
| Solution C" (dispersion of stabilizer [compound (I-10)] | 76.5 parts |
| Solution D (dispersion of stabilizer [compound (II-3)] | 34.0 parts |
| Kaoline clay (50% dispersion) | 12.0 parts |

Comparative Example 9

The thermal sensitive recording paper is prepared like Example 8. In the preparation of the color developing layer, solution D is prepared as follows.

| | |
|---|---|
| Solution D" (dispersion of stabilizer) compound (II-3) | 18.0 parts |
| 10% polyvinylalcohol aqueous solution | 84.6 parts |
| water | 50.4 parts |

Then, each dispersion is mixed and stirred as follows, and the coating color is prepared.

| | |
|---|---|
| Solution A (dispersion of color developer [D-8]) | 36.0 parts |
| Solution B (dispersion of basic leuco dye [S-205]) | 4.6 parts |
| Solution B (dispersion of basic leuco dye [ODB-2]) | 4.6 parts |
| Solution C (dispersion of stabilizer [compound (I-10)] | 34.0 parts |
| Solution D" (dispersion of stabilizer [compound (II-3)] | 153.0 parts |
| Kaoline clay (50% dispersion) | 12.0 parts |

<Evaluation of thermal sensitive recording medium>

Printing tests of thermal sensitive recording media prepared in above mentioned Examples and Comparative Examples are carried out using TH-PMD (thermal sensitive recording paper testing apparatus, to which thermal head [Kyosera Ltd.] is installed) made by Ohkura Denki Ltd., by 0.41 mj/dot impressive energy. Image density of the recorded portion of each specimen is measured by a Macbeth densitometer (RD-914 an amber filter is used), and the obtained results are regarded as the image density of untreated specimen. Wrapping film of polyvinylchloride (high wrap KMA; product of Mitsui Toatsu Ltd.) is wound around a paper tube to form a single layer, recorded sheet of the thermal sensitive recording medium is stuck on it, then the wrapping film of polyvinylchloride is wound over the sheet to form a triple layer. This specimen is left for 4 hours in the chamber of 40° C., and then the Macbeth density image portion is measured. And, density of ground color samely measured (refer to table 1 and table 2).

TABLE 1

Image Stability Test of Thermal Recording Medium (Example)

| Example | | | | | ground color | recording density | |
|---|---|---|---|---|---|---|---|
| Number | Developer | Dye | stabilizer | stabilizer | density | before test | after test |
| Example 1 | D-8 | S-205 | compound (I-10) | compound (II-3) | 0.04 | 1.25 | 0.94 |
| Example 2 | BPA | S-205 | compound (I-10) | compound (II-3) | 0.07 | 1.23 | 0.84 |
| Example 3 | BPA/D-8 | S-205 | compound (I-10) | compound (II-3) | 0.08 | 1.25 | 0.95 |
| Example 4 | D-8 | ODB-2 | compound (I-10) | compound (II-3) | 0.04 | 1.23 | 0.82 |
| Example 5 | D-8 | ODB | compound (I-10) | compound (II-3) | 0.07 | 1.27 | 0.97 |
| Example 6 | D-8 | PSD-170 | compound (I-10) | compound (II-3) | 0.08 | 1.30 | 1.05 |
| Example 7 | D-8 | CVL | compound (I-10) | compound (II-3) | 0.03 | 1.36 | 0.82 |
| Example 8 | D-8 | S-205/ODB-2 | compound (I-10) | compound (II-3) | 0.04 | 1.28 | 1.00 |
| Example 9 | D-8 | S-205/ODB-2 | compound (I-10) | compound (II-3) | 0.04 | 1.25 | 0.80 |
| Example 10 | D-8 | S-205/ODB-2 | compound (I-10) | compound (II-3) | 0.05 | 1.35 | 1.19 |
| Example 11 | D-8 | S-205/ODB-2 | compound (I-10) | compound (II-3) | 0.04 | 1.29 | 0.85 |
| Example 12 | D-8 | S-205/ODB-2 | compound (I-10) | compound (II-3) | 0.04 | 1.26 | 0.88 |
| Example 13 | D-8 | S-205/ODB-2 | (I-1)/(I-10) | compound (II-3) | 0.04 | 1.31 | 0.93 |
| Example 14 | D-8 | S-205/ODB-2 | compound (I-10) | compound (II-4) | 0.04 | 1.26 | 0.91 |
| Example 15 | D-8 | S-205/ODB-2 | compound (I-10) | (II-3)/(II-4) | 0.04 | 1.28 | 1.01 |

TABLE 2

Image Stability Test of Thermal Recording Medium (Comparative Example)

| Com. Eap | | | | | ground color | recording density | |
|---|---|---|---|---|---|---|---|
| Number | Developer | Dye | stabilizer | stabilizer | density | before test | after test |
| Co Exam 1 | D-8 | S-205 | no | no | 0.04 | 1.18 | 0.09 |
| Co Exam 2 | D-8 | S-205/OBD-2 | no | no | 0.04 | 1.21 | 0.12 |
| Co Exam 3 | D-8 | S-205/OBD-2 | compound (I-10) | no | 0.04 | 1.26 | 0.40 |
| Co Exam 4 | D-8 | S-205/OBD-2 | no | compound (II-3) | 0.04 | 1.20 | 0.21 |
| Co Exam 5 | D-8 | S-205/OBD-2 | no | (II-3)/(II-4) | 0.04 | 1.25 | 0.22 |
| Co Exam 6 | D-8 | S-205/OBD-2 | compound (I-10)*1 | compound (II-3) | 0.04 | 1.28 | 0.27 |

TABLE 2-continued

Image Stability Test of Thermal Recording Medium (Comparative Example)

| Com. Eap Number | Developer | Dye | stabilizer | stabilizer | ground color density | recording density before test | recording density after test |
|---|---|---|---|---|---|---|---|
| Co Exam 7 | D-8 | S-205/OBD-2 | compound (I-10) | compound (II-3)*2 | 0.04 | 1.27 | 0.41 |
| Co Exam 8 | D-8 | S-205/OBD-2 | compound (I-10)*3 | compound (II-3) | 0.04 | 0.85 | 0.63 |
| Co Exam 9 | D-8 | S-205/OBD-2 | compound (I-1) | compound (II-3)*4 | 0.04 | 0.89 | 0.33 |

proportion of stabilizer based on 1 part of developer
*1 0.005
*2 0.005
*3 1.5
*4 3

As clearly understood from the test results shown in Tables 1 and 2, the specimens of thermal sensitive recording medium prepared by Examples 1–15 of this invention which use the compound indicated by general formula (I) and the compound indicated by general formula (II) have remarkably superior image stability to a plasticizer compared with these prepared by Comparative Examples 1, 2 which do not use neither (I) or (II), or with these prepared by Comparative Examples 3–5 which use only (I) or (II). Therefore, although the compounds indicated by general formula (I) and (II) do not act as a stabilizer when they are used alone, when they are used together they indicate an excellent stabilizing effect.

Comparative Example 6 includes 0.005 parts of a compound indicated by general formula (I) and Comparative Example 8 includes 1.5 parts of a compound indicated by general formula (I) based on 1 part of developer. On the other hand, Comparative Example 7 includes 0.005 parts of a compound indicated by general formula (II) and Comparative Example 9 includes 3 parts of a compound indicated by general formula (II) based on 1 part of developer. Every specimen prepared by above mentioned Comparative Examples has a poor plasticizer resistance, especially, when the proportion of one compound is too much (Comparative Example 8 and 9), a recording density is low too. Accordingly, even if a compound of general formula (I) and (II) are included together, the desired stabilization can not be obtained unless the proportion of them satisfy the following condition. That is ; includes 0.01–0.9 parts of a compound of general formula (I) of this invention based on 1 part of developer, and 0.01–2 parts of a compound of general formula (II) based on 1 part of developer.

Further, from Example 1 and Example 2, it is indicated that the use of "D-8" as the developer is superior to the use of "BPA" in the coloring of the ground color. Similarly, a product having better plasticizer resistance can be obtained by using "D-8". In case of a single use of basic leuco dye, the difference of a plasticizer resistance caused by the difference of basic leuco dye, Example 6 which uses "PSD-170" shows the best result, however, it has a problem of a ground color. On the contrary, Example 8 which uses "S-205" together with. "OBD-2" shows a good result both on the plasticizer resistance and the ground color.

The thermal sensitive recording medium of this invention not only has a sufficient color developing sensitivity but also has an excellent image stability, especially against a plasticizer. Therefore, since the recorded image does not fade by the contact with plasticizer included in a wrapping film or in a leatherwork, the thermal sensitive recording medium can be broadly applied for a practical use. Additionally, since the thermal sensitive recording medium of this invention includes a compound indicated by general formula (I) and (II), it is possible to provide a plasticizer resistance without a protective layer, therefore, it can be said as an excellent product from the economical view point.

We claim:

1. A thermal sensitive recording medium comprising a substrate having thereon a thermal sensitive color developing layer, wherein the color developing layer comprises a colorless or pale colored basic leuco dye, an organic color developer, 0.01 to 0.9 parts of aminobenzenesulfonamide stabilizer of the formula (I), based on 1 part of the color developer,

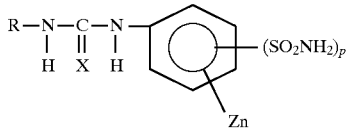

(I)

wherein, X is an oxygen or sulfur atom, R is a non-substituted or substituted group which is selected from the group consisting of phenyl group, naphthyl group, aralkyl group, lower alkyl group of 1–6 carbon atoms, cycloalkyl group of 3–6 carbon atoms and lower alkenyl group of 2–6 carbon atoms, Z is a lower alkyl group of 1–6 carbon atoms or electron attractive group, n is an integer from 0 to 4 and p is an integer from 1 to 5, wherein in the numerical formula $n+p \leqq 5$, and wherein the recording layer contains 0.01–2 parts of methylated fatty acid amide stabilizer of the formula (II), based on 1 part of the color developer, $$R_1—CONHCH_2OH \quad (II)$$

wherein, $R_1$ is an alkyl group of 11–21 carbon atoms.

2. The thermal sensitive recording medium of claim 1, wherein the color developing layer comprises 0.1–2 parts of leuco dye, based on 1 part of the color developer.

3. The thermal sensitive recording medium of claim 1, wherein the color developer is selected from the group consisting of bisphenol developers and mono-phenolic sulfone developers.

4. The thermal recording medium according to claim 1 wherein in formula (I) p is an integer from 1 to 3.

5. The thermal recording medium according to claim 4 wherein in formula (II) $R_1$ is an alkyl group selected from the group consisting of 16, 17 and 21 carbon atoms and mixtures thereof.

6. The thermal recording medium according to claim 1 wherein in formula (II) $R_1$ is an alkyl group selected from the group consisting of 16, 17 and 21 carbon atoms and mixtures thereof.

7. The thermal recording medium of claim 1 wherein in the formula (I) the R group includes a substituent selected from the group consisting of methyl, ethyl, isopropenyl, fluorine, chlorine, bromine and nitro.

8. The thermal recording medium of claim 1, wherein in the formula (I) Z is a member selected from the group consisting of methyl, ethyl, fluorine, chlorine, bromine and nitro.

9. A thermal sensitive recording medium according to claim 1 wherein the thermal sensitive color developing layer comprises a stabilizer of the formula (I) which includes at least one compound of formula:

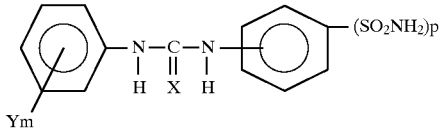

wherein X is oxygen atom, Y is a lower alkyl group of 1 to 6 carbon atoms or an electron attracting group and m is an integer from 0 to 3 and p is 1 to 3, and wherein the thermal sensitive color developing layer also comprises a stabilizer of the formula (II) which includes at least one methylolated fatty acid amide of the formula:

$R_1$—CONHCH$_2$OH wherein $R_1$ is an alkyl group of 16 to 21 carbon atoms.

10. A thermal sensitive recording medium according to claim 9, wherein the thermal sensitive color developing layer comprises a stabilizer of the formula (I) which includes at least one compound of formula:

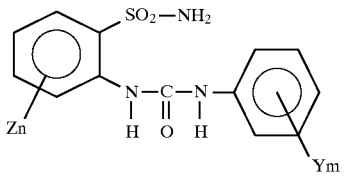

wherein Y is a member selected from the group consisting of ethyl, methoxy, chlorine, bromine, nitro and CN and m is an integer from 0 to 3, Z is bromine and n is an integer from 0 to 1.

11. A thermal sensitive recording medium according to claim 9 wherein the thermal sensitive color developing layer comprises a stabilizer of the formula I which includes at least one compound of formula:

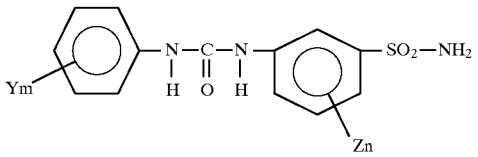

wherein Z is chlorine and n is an integer from 0 to 2, Y is a member selected from the group consisting of methyl, methoxy, chlorine, bromine and nitro and m is an integer from 0 to 2.

12. A thermal sensitive recording medium according to claim 9 wherein the thermal sensitive color developing layer comprises a stabilizer of the formula (I) which includes at least one compound of formula:

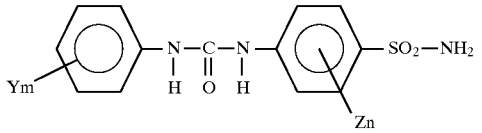

wherein Y is a member selected from the group consisting of methyl, chlorine, fluorine, methoxy and nitro and m is an integer from 0 to 2, and Z is chlorine and n is an integer of 0 to 2.

13. A thermal sensitive recording medium according to claim 1 wherein the thermal sensitive color developing layer comprises a stabilizer of the formula (I) which includes at least one compound of formula:

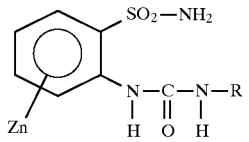

R is a substituted or unsubstituted group selected from the group consisting of an alkyl group having 1 to 3 carbon atoms, a cyclohexyl group, a propenyl group and a naphthyl group, wherein the alkyl group may contain a phenyl substituent, a methyl phenyl substituent or a propenyl phenyl substitutent, and Z is methyl and n is an integer of from 0 to 1.

14. The thermal sensitive recording medium of claim 13 wherein the alkyl group is a member selected from the group consisting of methyl, isopropyl and propenyl.

15. A thermal sensitive recording medium according to claim 1 wherein the thermal sensitive color developing layer comprises a stabilizer of the formula (I) which includes at least one compound of formula:

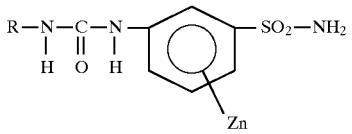

R is a substituted or unsubstituted group selected from the group consisting of an alkyl group having 1 to 3 carbon atoms, a cyclohexyl group, a propenyl group and a naphthyl group, wherein the alkyl group may contain a phenyl substituent, a chlorophenyl substituent or a propenyl phenyl substitutent, and Z is methyl or chlorine and n is an integer of from 0 to 3.

16. The thermal recording medium of claim 15 wherein the alkyl group is a member selected from the group consisting of methyl, isopropyl, propyl and propenyl.

17. A thermal sensitive recording medium according to claim 1 wherein the thermal sensitive color developing layer comprises a stabilizer of the formula (I) which includes at least one compound of formula:

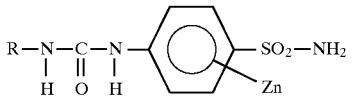

R is a substituted or unsubstituted group selected from the group consisting of an alkyl group having 1 to 3 carbon atoms, a cyclohexyl group, a methyl cyclohexyl group, a vinyl group and naphthyl group, wherein the alkyl group may contain a phenyl substituent, a bromo phenyl substituent or a propenyl phenyl substitutent, and Z is bromine and n is an integer of from 0 to 2.

18. The thermal recording medium of claim 17 wherein the alkyl group is a member selected from the group consisting of methyl, isopropyl and propenyl.

19. A thermal sensitive recording medium according to claim 1 wherein the thermal sensitive color developing layer comprises a stabilizer of the formula (I) which includes at least one compound of formula:

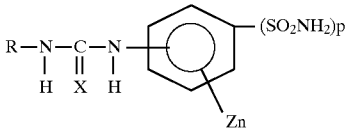

wherein X is sulfur atom; and R is a substituted or unsubstituted group which is selected from the group consisting of phenyl group, naphthyl group, aralkyl group, a lower alkyl group of 1 to 6 carbon atoms, cycloalkyl group of 3 to 6 carbon atoms, and a lower alkenyl group of 2 to 6 carbon atoms, Z is a lower alkyl group of 1 to 6 carbon atoms or an electron attracting group, n is an integer from 0 to 4, and p is an integer of 1 to 5, satisfying $n+p \leqq 5$, and wherein the thermal sensitive color developing layer also comprises a stabilizer of the formula (II) which includes at least one methylolated fatty acid amide of the formula:

$R_1$—$CONHCH_2OH$ wherein $R_1$ is an alkyl group of 11 to 21 carbon atoms.

20. A thermal sensitive recording medium according to claim 19 wherein the thermal sensitive color developing layer comprises a stabilizer of the formula (I) which includes at least one compound of formula:

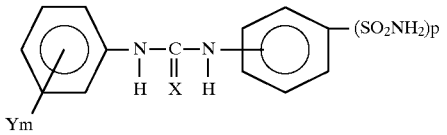

wherein X is sulfur atom, Y is a lower alkyl group of 1 to 6 carbon atoms or an electron attracting group, and m is an integer from 0 to 3, and p is 1 to 3, and wherein the thermal sensitive color developing layer also comprises a stabilizer of the formula (II) which includes at least one methylated fatty acid amide of the formula:

$R_1$—$CONHCH_2OH$ wherein $R_1$ is an alkyl group of 16 to 21 carbon atoms.

21. A thermal sensitive recording medium according to claim 20, wherein the thermal sensitive color developing layer comprises a stabilizer of the formula (I) which includes at least one compound of formula:

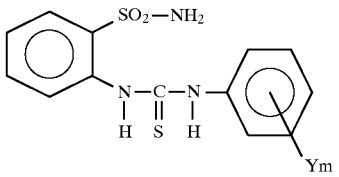

wherein Y is methoxy and m is an integer from 0 to 1.

22. A thermal sensitive recording medium according to claim 20 wherein the thermal sensitive color developing layer comprises a stabilizer of the formula (I) which includes at least one compound of formula:

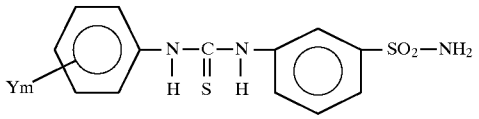

wherein Y is chlorine and m is an integer from 0 to 2.

23. A thermal sensitive recording medium according to claim 20 wherein the thermal sensitive color developing layer comprises a stabilizer of the formula (I) which includes at least one compound of formula:

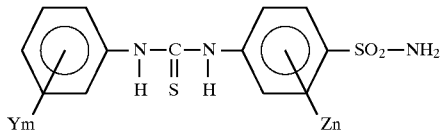

wherein Y is a member selected from the group consisting of methyl, methoxy and chlorine and m is an integer from 0 to 1, and Z is chlorine and n is an integer from 0 to 4.

24. The thermal sensitive recording medium according to claim 19, wherein the R group includes a substituent selected from the group consisting of methyl, ethyl, isopropenyl, fluorine, chlorine, bromine and nitro.

25. The thermal sensitive recording medium according to claim 19, wherein Z is a member selected from the group consisting of methyl, ethyl, fluorine, chlorine, bromine and nitro.

26. A thermal sensitive recording medium according to claim 19 wherein the thermal sensitive color developing layer comprises a stabilizer of the formula (I) which includes at least one compound of formula:

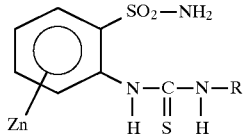

R is a substituted or unsubstituted alkyl group having 1 to 3 carbon atoms, wherein the alkyl group may contain a phenyl substituent or a propenyl phenyl substituent and Z is methyl and n is an integer of from 0 to 1.

27. The thermal sensitive recording medium according to claim 26 wherein the alkyl group is a member selected from group consisting of methyl, isopropyl and propyl.

28. A thermal sensitive recording medium according to claim 19 wherein the thermal sensitive color developing layer comprises a stabilizer of the formula (I) which includes at least one compound of formula:

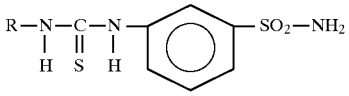

R is a substituted or unsubstituted group selected from the group consisting of an alkyl group having 1 to 3 carbon atoms, a cyclohexyl group, and a naphthyl group, wherein the alkyl group may contain a propenyl phenyl substituent.

29. The thermal sensitive recording medium of claim 28, wherein the alkyl group is isopropyl.

30. A thermal sensitive recording medium according to claim 19 wherein the thermal sensitive color developing layer comprises a stabilizer of the formula (I) which includes at least one compound of formula:

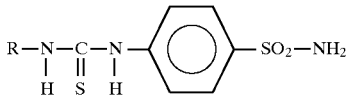

R is a substituted or unsubstituted group selected from the group consisting of an alkyl group having 1 to 3 carbon atoms, a cyclohexyl group and a propenyl group, wherein the alkyl group may contain a phenyl substituent.

31. The thermal sensitive recording medium according to claim 30 wherein the alkyl group is methyl.

* * * * *